US005588687A

United States Patent [19]

Pinkerton

[11] Patent Number: 5,588,687

[45] Date of Patent: Dec. 31, 1996

[54] CHILD PROOF REFRIGERATOR DOOR LATCH

[76] Inventor: William R. Pinkerton, P.O. Box 3035, Brownsville, Tex. 78523

[21] Appl. No.: 288,826

[22] Filed: Aug. 11, 1994

Related U.S. Application Data

[63] Continuation-in-part of Ser. No. 140,851, Oct. 25, 1993, Pat. No. 5,387,018.

[51] Int. Cl.[6] ..... E05C 19/18

[52] U.S. Cl. ..... 292/259 R; 292/262; 292/DIG. 71; 108/50

[58] Field of Search ..... 292/259, 262, 292/281, 288, 106, 63, DIG. 28, DIG. 43, DIG. 53, DIG. 65, DIG. 71, 264, 95; 248/346.1, 447.1, 444; 362/98, 99; 108/43, 50

[56] References Cited

U.S. PATENT DOCUMENTS

| | | | |
|---|---|---|---|
| 2,516,239 | 7/1950 | Moss | 248/444 |
| 3,381,122 | 4/1968 | Boyle, Jr. | 362/99 |
| 4,889,372 | 12/1989 | Dege et al. | 292/264 X |
| 4,892,334 | 1/1990 | Sinclair | 248/444 X |
| 5,388,876 | 2/1995 | Saincome | 292/DIG. 71 X |

FOREIGN PATENT DOCUMENTS

| | | | |
|---|---|---|---|
| 214217 | 4/1909 | Germany | 292/264 |

*Primary Examiner*—Rodney M. Lindsey
*Attorney, Agent, or Firm*—Daniel Vera

[57] ABSTRACT

A device or kit for making a refrigerator door child proof is disclosed. The device comprises about four distinct parts: a segment of shock cord (lanyard), a spring clasp having a swivel eyelet butt end connected to one end of the shock cord, a first adhesive backed mounting plate with a loop for receiving the spring clasp (first mounting plate), another adhesive backed mounting plate for tethering the spring clasp to via the lanyard (second mounting plate). The first mounting plate is adhered to a refrigerator door. The second mounting plate having the spring clasp and lanyard mounted thereto is either adhered to a second refrigerator door or the side of the refrigerator. When the door is opened by a child the shock cord allows the door to only slightly be opened. The shock cord then springs back to its relaxed state quickly shutting the door. The spring clasp can be operated by an adult by one hand. The device can be disabled by leaving the spring clasp unhooked. The device can only deliberately be enabled. Dependent claims include additional features separately or combined: double spring clasp, clock, night light, writing surface, timer, paper clamp, pot-holder hooks, pencil holder and pencil lanyard.

19 Claims, 7 Drawing Sheets

CHILD PROOF REFRIGERATOR DOOR LATCH

This is a continuation-in-pad of patent application Ser. No. 08/140,851 filed Oct. 25, 1993 now U.S. Pat. No. 5,387,018.

BRIEF SUMMARY OF INVENTION

This invention relates to a child proof refrigerator door latch. The latch comprises about four distinct parts: a shock cord, hereafter sometimes referred to as an elastic lanyard or simply, "lanyard," a safety latch or spring clasp having a latch end and a swivel eyelet end, hereafter referred to as a spring clasp, connected by the eyelet to one end of the lanyard; a first adhesive backed mounting plate with a loop on mounted to its front side in a plane perpendicular to the mounting plate front side, for providing means for receiving the spring clasp; a second adhesive backed mounting plate for attaching, or mounting the end of the lanyard opposite the spring clasp to, thereby tethering the spring clasp to the second mounting plate via the lanyard. The first mounting plate is adhered to a refrigerator door. The second mounting plate having the lanyard tethered spring clasp attached, is either adhered to a second door or the side of the refrigerator. The spring clasp can be operated by an adult using one hand. The door latch can be disabled by leaving the spring clasp unhooked, for example: during the absence of children in the home. When the spring clasp is engaged to the looped pad the entire mechanism or latch, works when a child of modest strength tries to open the refrigerator; the elastic lanyard works to immediately re-close the refrigerator door. After several attempts the child becomes frustrated and ceases to operate the door. The invention is also claimed in combination with several kitchen amenities such as writing pad, clip board, cooking timers, clocks and night light either severally or in combination with one or more of each other.

BACKGROUND OF THE INVENTION

1. Field of Invention

This invention relates to latches and kits for making refrigerator doors child proof by placing a releasable latch on the door.

2. Background Art

Child proof latches are known and refrigerator door locks are known it is believed however that to date there has not been a child proof refrigerator door latch made or conceived that is within the parameters of the instant invention. Cabinet door or drawer child proof locks are typically comprised of two parts where one part is usually mounted to a fixed surface and the other part is mounted to a moving surface such as a door or drawer. The pieces usually automatically engage each other thus becoming latched or mated upon closure of a door or drawer and remain hidden within the closure. Unlatching the pieces usually involves slightly opening the door or drawer and disengaging the locked pieces manually. These latches, unlike the present invention, typically cannot be disabled, without physically dismounting or breaking the mechanism, and cannot operate to re-close a slightly opened door. The present invention requires deliberate enablement of the latch.

One U.S. Pat. No. Des. 324,367 and Des. 326,402 displays the above mentioned features for a refrigerator door latch and its operation is readily understandable to wit: it is made of two pieces, one piece has a resilient arm with a hole in it for receiving a catch. The catch is on the other piece.

Both pieces have an adhesive surface for mounting to refrigerator type doors.

One piece operates as a fixed hook and the other piece is an elongated loop which springs over and automatically engages the hook whenever the door is closed. Apparently the pieces are made to allow for a margin of error in placement of the pieces in their operative relative juxtaposition.

DISTINCTION OF THE PRESENT INVENTION

The advantages of the present invention are several: that entry to a refrigerator door is made child proof; that the latch can be disabled; the margin of error in mounting the device is greater than what is known in the prior art; the mounted pieces may be identical, but need not be; several useful amenities may be added to the latch creating a multifunction device that is otherwise useful in the kitchen; the lanyard operates to re-close a refrigerator door, saving energy and cold atmosphere within the refrigerator; The latch must be deliberately enabled thereby avoiding the accidental automatic locking in of a child playing with the door as may be encountered with other designs; the reclosing effect operates to frustrate repeated attempts to open the refrigerator door by a child of moderate strength ultimately resulting in the child's disinterest in opening the refrigerator door; the use of a spring latch requires coordination which a child generally lacks in order to operate the latch to gain entry into a secured door, in that, the child must simultaneously open the spring latch and while working against the tension of the shock cord, disengage the latch.

BEST MODE FOR CARRYING OUT THE INVENTION

The present invention relates to a child proof refrigerator door latch, which comprises about five major elements which are: Two independent mounting plates, hereafter distinguished as either the target plate or the utility plate; adhesive backing on each of the two independent mounting plates; a spring closed latch hook clasp having a swivel eyelet butt end and a releasable clasping end, hereafter spring clasp, and an elastic lanyard having a limited stretch capability of from about thirty percent of diameter to about 250 percent of diameter.

The target plate, further comprises a loop on its outer surface for receiving the clasp. The utility plate, also further comprises a loop for securing one end of approximately from 2 to 30 inches of elastic lanyard such as shock cord to it. Hereafter, unless otherwise distinguished, "elastic lanyard"0 is referred to as simply, "lanyard". The loops may or may not be identical. The mounting plates may or may not be identical. The lanyard segment has only two ends. One end is attached to the loop of the utility plate. The now unattached end of the lanyard is attached to the eyelet at the butt end of the spring clasp. A preferably plastic, spring clasp with a swivel butt eyelet end is used. The first target plate is fixed to a refrigerator door preferably above the reach of children. The second utility plate is fixed to the refrigerator main body or a second refrigerator door, so that the lanyard will extend only slightly stretching to allow the clasping end of the clasp to be easily engaged the loop on the target plate. The mounting plates may be pre-drilled with holes for mounting with rivets or screws. The mounting plates range in size from one square inch to two hundred fifty square inches. The loops comprise rings mounted or molded onto the mounting plates. The mounting plates are made of metal or plastic or wood or glass or a combination thereof. The rings have an inner diameter of from about one half inch to about two inches and may be oval in shape having the aforementioned diameters in respective minor and major diameters and they may also be approximately square instead of circular or oval with the same range of dimensions as described above. The cross section of a ring segment would range in size from one sixteenth inch square to three eighths inch square. The length of lanyard depends on the application but is generally made so that the refrigerator door to which the device is attached cannot be opened enough to allow a child to reach in and withdraw items from the refrigerator before encountering the full extended limit of the shock cord. Another equally good embodiment differs from the above only in that the lanyard is made to have a spring clasp at both ends thus allowing disablement at either end such as may be preferable in side by side refrigerator door configurations or to allow easy removal of the lanyard and clasp assembly when no longer needed.

Still another equally good embodiment involving no spring clasp, is where both mounting plate loops are made into open loops which when mounted to a refrigerator door are nearly identical in shape and size to the loops but have a segment removed so as to just allow a loop of lanyard to be slipped onto the open loop. The mounting plates with the open loops are mounted with the open loops mouths facing away from each other so that a shock cord having loops at both ends can be hooked onto one open loop and stretched to the other open loop thus connecting them and effecting a latch on the refrigerator door or doors.

For ease of manufacture, the shock cord may be made to only require one connection. To accomplish this, the shock cord is simply threaded through both the utility plate loop and the eyelet of the spring clasp and then both ends of the shock cord are clamped together with a single metal crimping clamp or tied together by other means. Another possibility is to connect two spring clasps by the same method.

Yet another equal embodiment combines the above mentioned features with one or more other kitchen amenities such as battery operated clocks, timers; note pads, battery operated night lights, pot holder hooks, paper clamps, pen/pencil holders and utility hooks, all made or mounted, onto one or both of the mounting plates in any variety of positions and juxtapositions being limited by the dimensions of the mounting plates.

Still yet another embodiment is where the first and second mounting plates are made from any one or two or multiple combinations of the following materials: wood, plastic, steel, brass, bronze, copper, stainless steel, fiberglass, aluminum, magnesium, zinc coated iron, corrosion resistant metal alloys.

DETAILED DESCRIPTION

Figure 1:
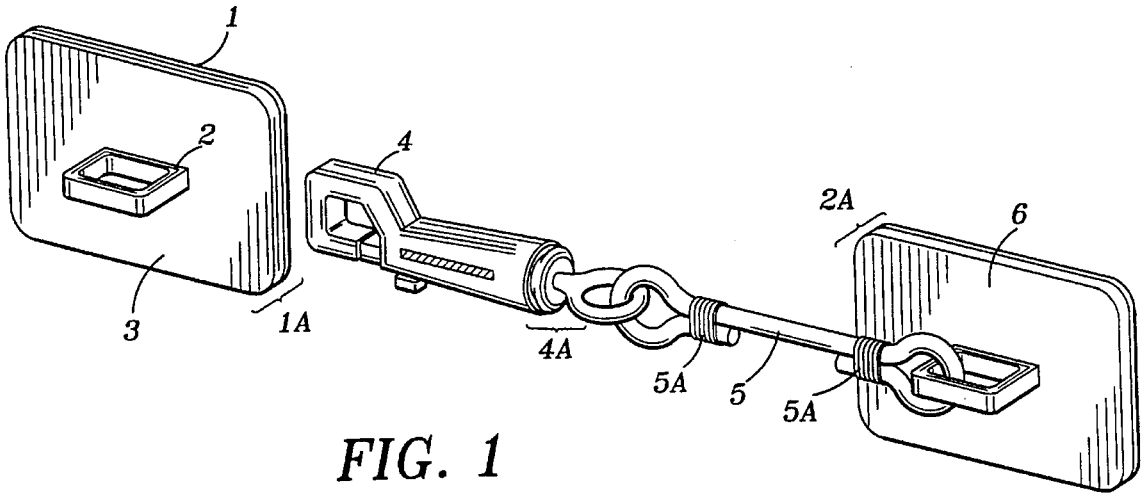
FIG. 1 is a pictorial view of the component parts of a refrigerator door child proof mechanism.
Figure 2:
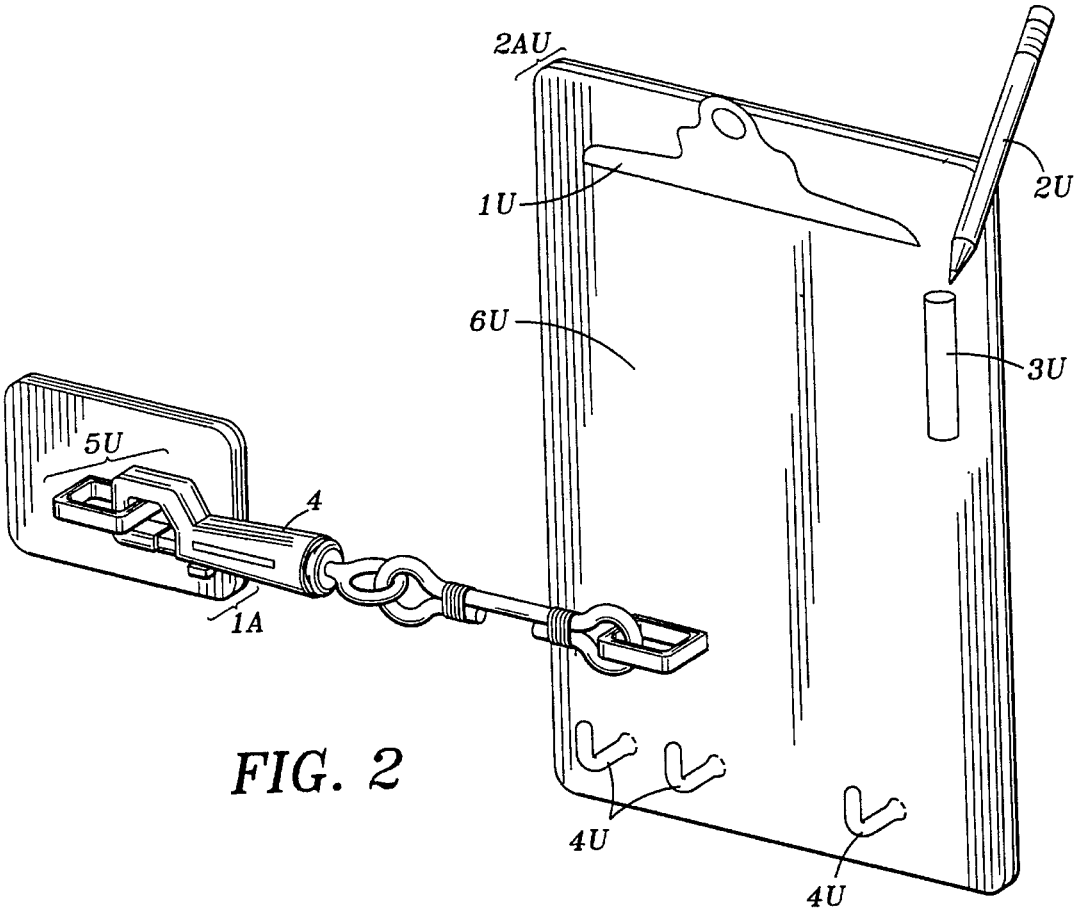
FIG. 2 is a view of assembled pieces of a device for making a refrigerator door child resistant and showing the addition of a paper clamp, pencil holder and utility hooks and writing pad.
Figure 3:
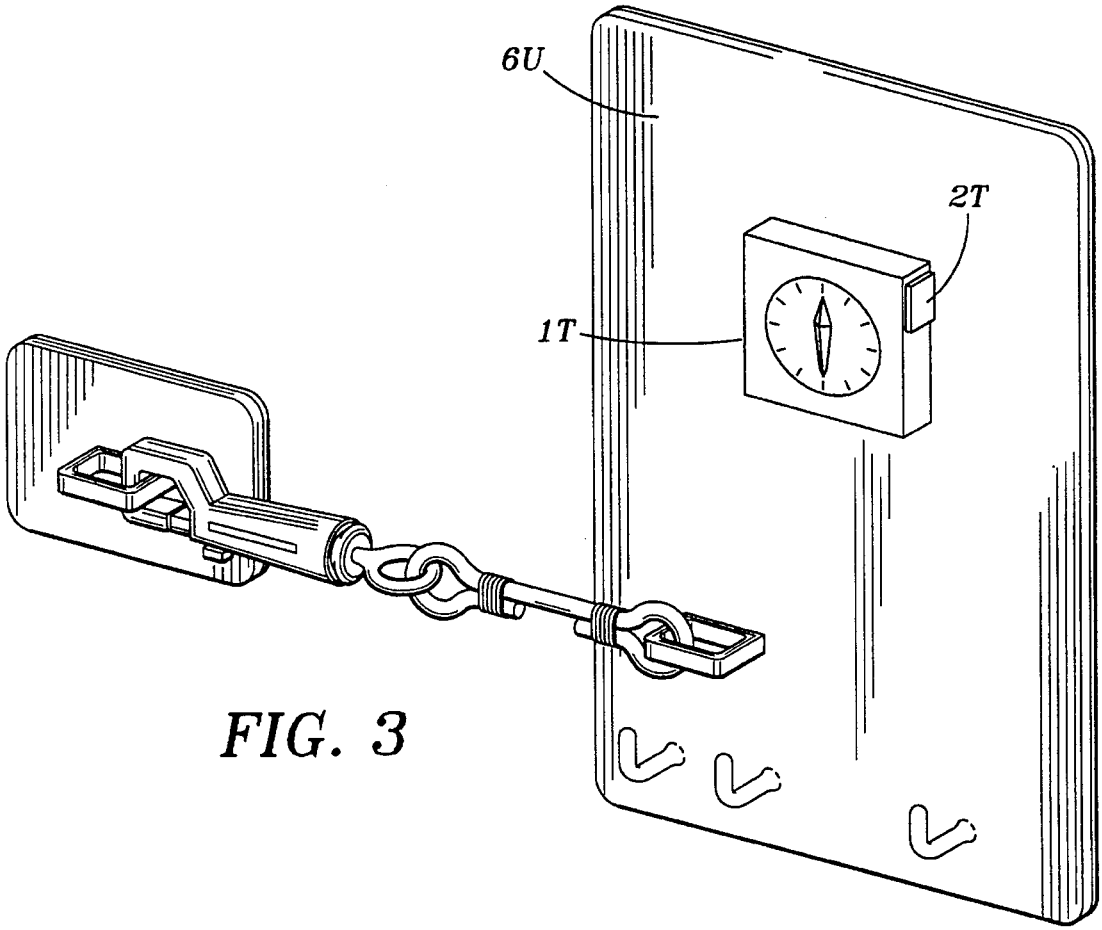
FIG. 3 Is an alternate embodiment of the mechanism with a cooking timer mounted to a writing pad having utility hooks.
Figure 4:
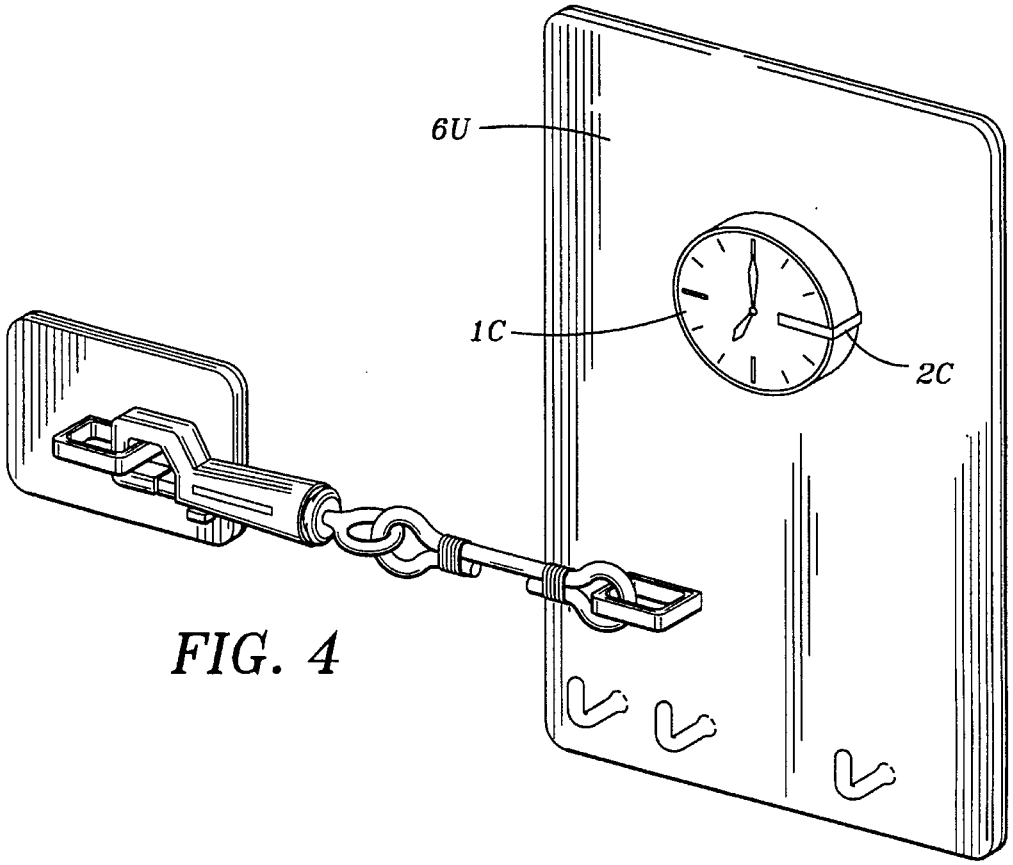
FIG. 4 Is an alternate embodiment of the mechanism with a clock mounted to a writing pad having utility hooks.
Figure 5:
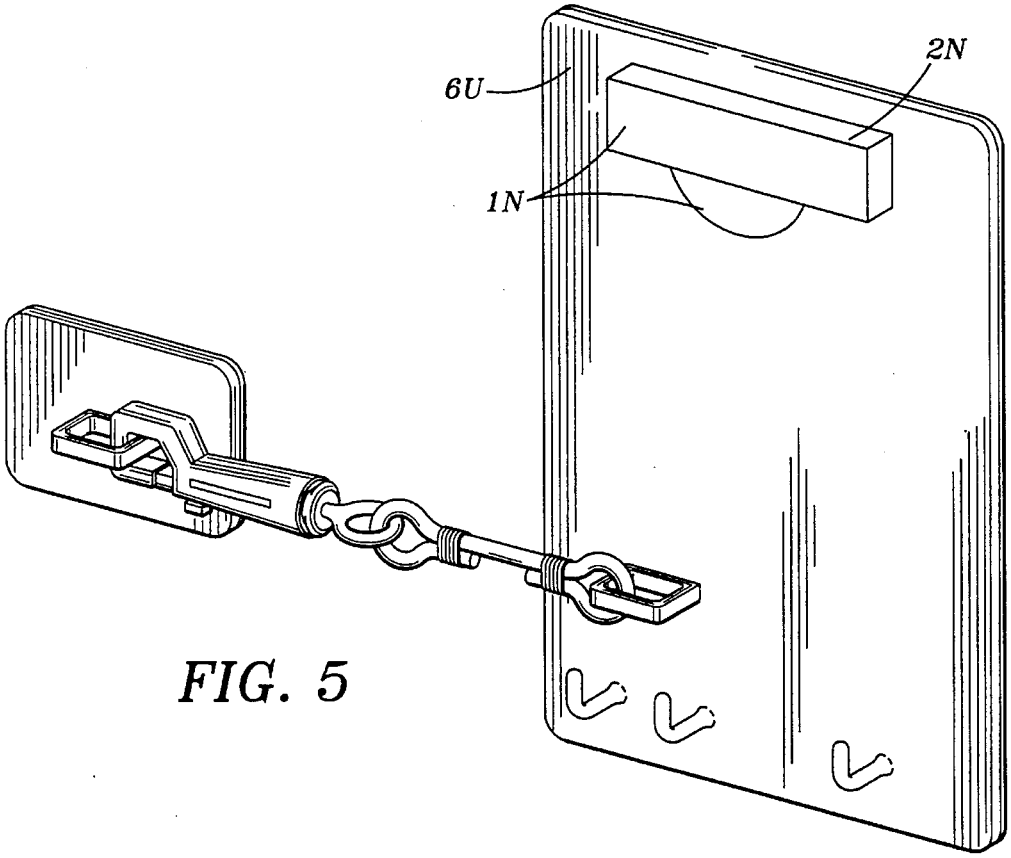
FIG. 5 Is an alternate embodiment of the mechanism with a night light to a writing pad having utility hooks. Shows the mounting of an embodiment showing a night light.
Figure 6:
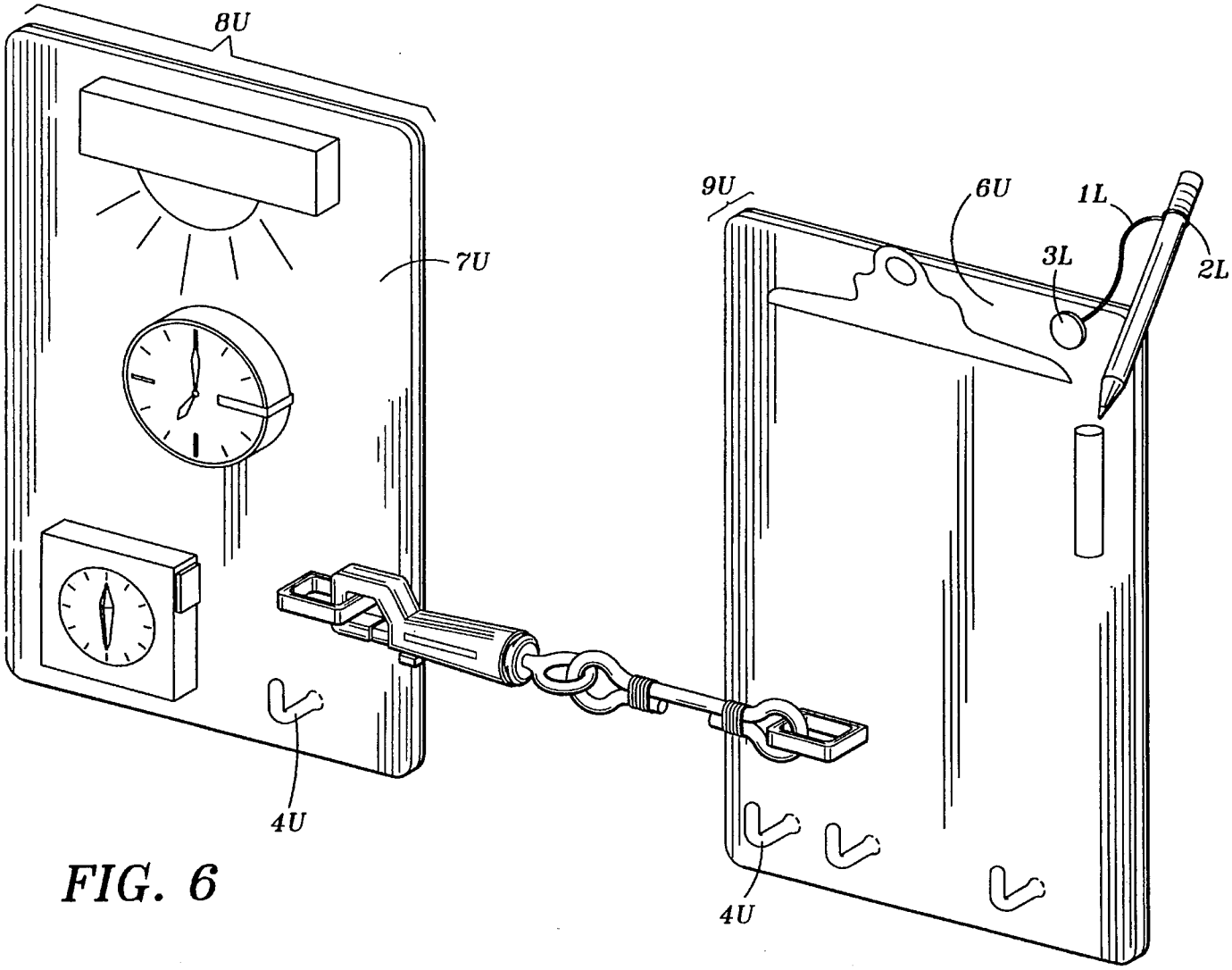
FIG. 6 Shows an embodiment showing a the device in combination with two mounting plates which comprise writing pads and on one pad a night light, cooking timer, one utility hook and clock; the other mounting plate is shown having a paper clamp, pencil holder and three utility hooks.
Figure 12:
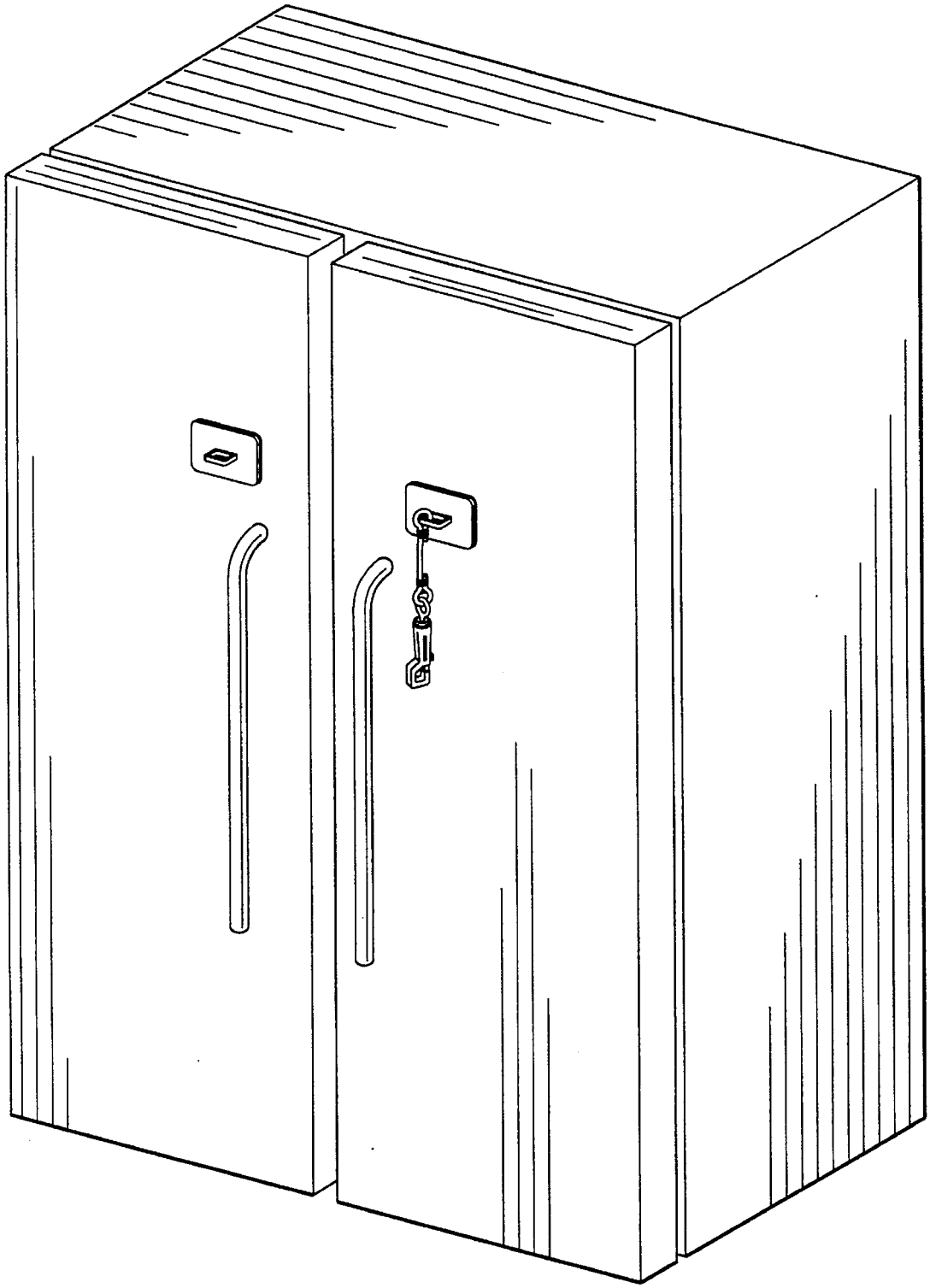
FIG. 12 embodiment being used on a side by side refrigerator door style refrigerator.

This invention provides a child proof door latch mechanism for a refrigerator door. As shown in FIG. 1, two identical mounting plates 1*a* and 2*a* are shown. Mounting plate 1*a*, hereafter sometimes referred to as, target plate, is shown having an adhesive backing 1 for adhering the mounting plate to a refrigerator door and a loop 2 on its face 3. A second mounting plate 2*a*, hereafter sometimes referred to as, utility plate, is shown having a shock cord 5 hereafter sometimes referred to as, lanyard, attached on one end to a loop on the second mounting plate and on the other end to the swivel butt end 4*a* of a spring clasp 4. It also has an adhesive backing. Referring to FIG. 2, two different mounting plates are shown, 1*a* and 2*au*, each with the adhesive backing with a shock cord being shown attached on one end to the loop on the utility plate 2*au*, and the other end to a clasp 4. Referring to FIG. 2, the clasp is shown hooked onto the loop 5*u* on the target plate 1*a* the plates would be typically mounted on a refrigerator in the most advantageous way the user may desire, either one plate on each of two side by side refrigerator/freezer doors as shown in FIG. 12, or with one utility plate on the door and the target plate on the side of the refrigerator of a single door of a top and bottom door style refrigerator/freezer. It is intended that the lanyard may be appended to either plate by any suitable means such as snaps or screws or cleats. Referring to FIGS. 2 through 6 there is shown variations of the utility plate 2*au*, the surface of these plates is intended to be a smooth writing surface if the mounting plates were made of either plastic or of paper or metal or of a composite material or it may be a painted on surface. Hereafter the utility plate with writing surface is sometimes referred to as, note pad. In any event the smooth writing surface may be for erasably marking on with erasable ink pens or pencils and would preferably be non-porous. The writing surface may made suitable for writing on with chalk. FIG. 2 shows a spring energized paper clamp 1*u*, a writing instrument 2*u*, a writing instrument holder cup 3u, and three utility hooks located on the bottom 4*u*, which have the minimum capability of holding car keys, potholders and plastic grocery bags. FIG. 3 shows some of the same functional pieces described above with the limitation that the utility plate to which the shock cord is mounted to also comprises a cooking timer mounted on the face of the note pad. The timer may be mechanical or electronic but in either event it must be able to be wound or have its batteries replaced by operating on the timer where it is situated on the face of the note pad 6*u* as shown in FIG. 3. For this purpose the timer is shown having a battery access door 2*t* as shown in FIG. 3. The note pad may be molded or have mounting tabs to house timers that are already available to or possessed by consumers. FIG. 4, is nearly identical to FIG. 3 with the exception that a clock is shown on the face of the note pad with a similar access door 2*c*, for battery replacement. FIG. 5, is nearly identical to FIG. 3 with the exception that a night light is shown on the face of the note pad with a similar access door 2*n*, for battery replacement. FIG. 6, shows two mounting plates 8*u*, and 9*u*, each having a variety of the previously described amenities mounted in combination onto either of the mounting plates. Additionally mounting plate 9*u*, has a means such as a snap button or screw 3*l*, for semi-permanently mounting a cord or string 1*l*thereto in order to tether a pen or pencil 2*l*, to the note pad.

Figure 7:
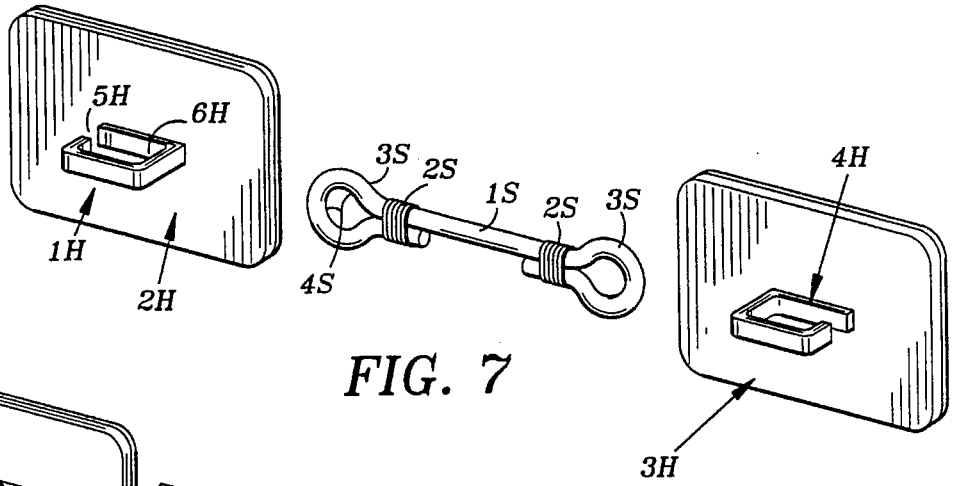
FIG. 7 Shows the mounting of an embodiment showing how hooks may be used in stead of loops and shock cord having only loops on its ends to connect the two mounting plates.

FIG. 7 shows another equally good embodiment involving no spring clasp, here both mounting plates 2*h* and 3*h* loop's are made into open loops which when mounted to a refrigerator door are nearly identical in shape and size to the loops previously described but have a segment removed 5*h* so as to just allow a closed loop 3*s* of lanyard 1*s* to be slipped onto the open loop. The lanyard loops have an inner loop diameter 4*s* of from one eighth inch to two inches and wherein further the loops are fixed in place by metal crimp clamps or by tying with wire or thread or string said loop formed on and of itself on at least one end by means of clamping down an end of said lanyard that has been folded over onto itself forming a closed loop at the end of said lanyard 3*s*, in another embodiment the loop of the first and/or second mounting plate is comprised of a open loop having a mouth 5*h* and a cupping segment 6*h*. The open loop comprising from about one half circle to about fifteen sixteenths circle of a complete loop. The open loops or loops have one edge tangent 4*h* along a segment of the loop or open loop with said mounting plate and. The mounting plates with the open loops are mounted with the open loops mouths facing away from each other so that a shock cord having loops at both ends can be hooked onto one open loop and stretched to the other open loop thus connecting them and effecting a latch on the refrigerator door or doors.

Figure 8:
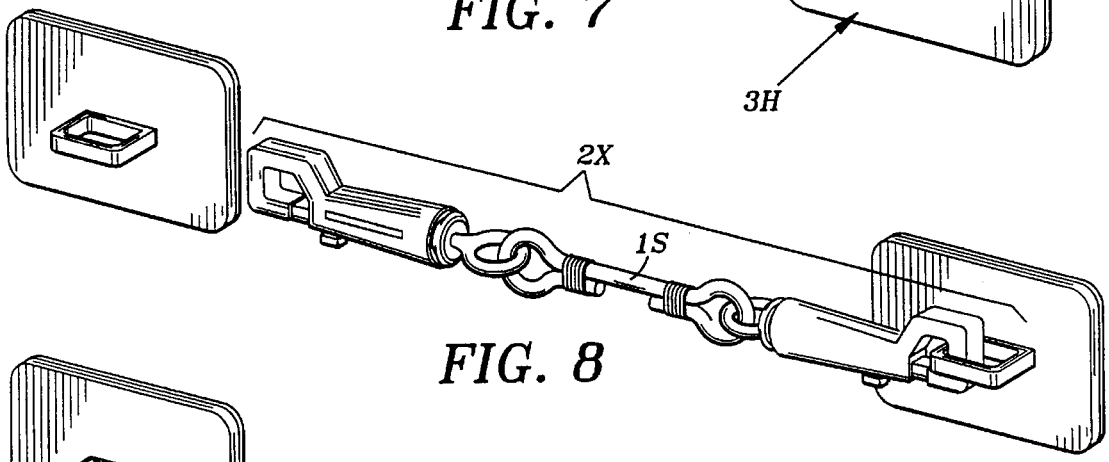
FIG. 8 Shows the mounting of an embodiment showing how a shock cord having, swivel eyelet butt end spring clasps, at each end may be used to connect the two mounting plates.

FIG. 8 shows the lanyard 1*s* is made to have a spring clasp at both ends 2*x* thus allowing disablement at either end such as may be preferable in side by side refrigerator door configurations or to allow easy removal of the lanyard and clasp assembly when no longer needed.

Figure 9:
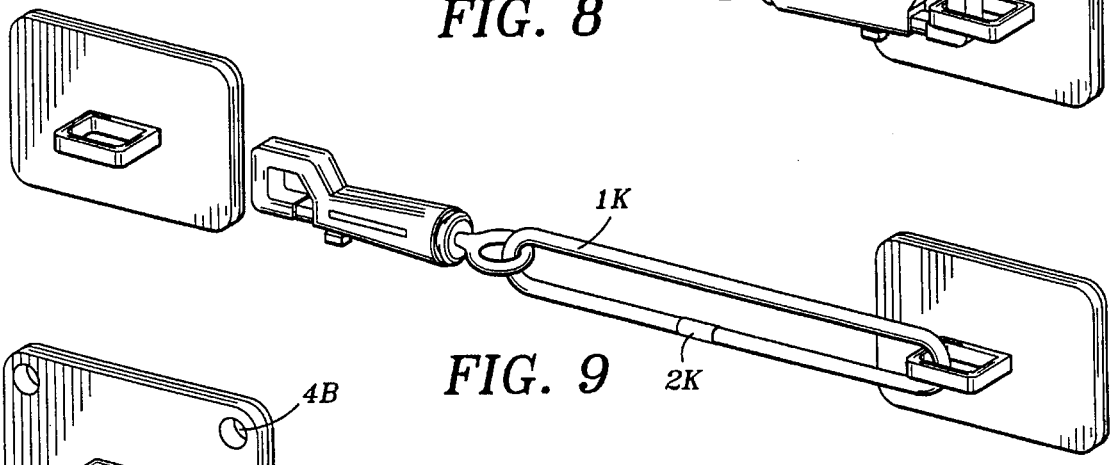
FIG. 9 Shows the primary embodiment with an alternate means for connecting the spring clasp butt end to one of the mounting plates.

FIG. 9 shows, for ease of manufacture, the shock cord 1*k* may be made to only require one connection 2*k*. To accomplish this, the shock cord is simply threaded through both the utility plate loop and the eyelet of the spring clasp and then both ends of the shock cord are clamped together with a single metal crimping clamp or tied together by other means. Another possibility is to connect two spring clasps by the same method.

Figure 10:
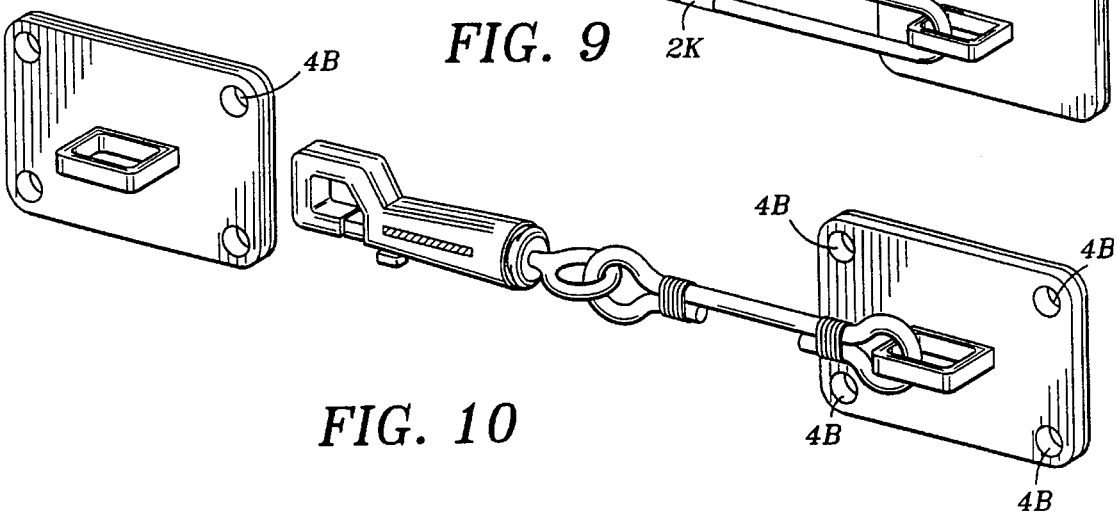
FIG. 10 Shows the primary embodiment with an alternate means for mounting the mounting plates via pre drilled holes in the mounting plates.
Figure 11:
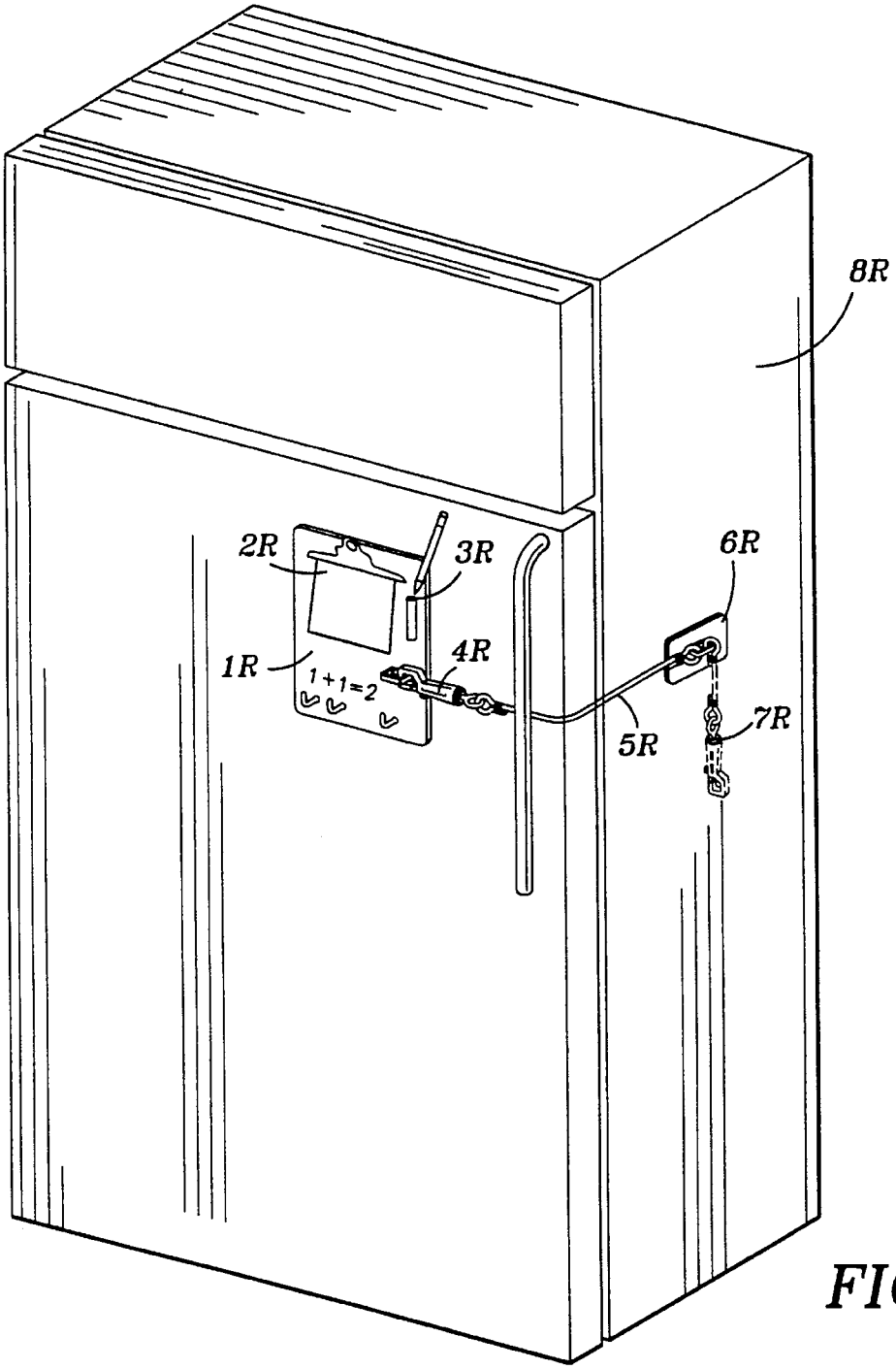
FIG. 11 Shows an embodiment being used on a top and bottom refrigerator door style refrigerator.

FIG. 10 is identical to FIG. 1 with the addition that holes 4*b* are shown pre drilled in the mounting plates for fastening with rivets, screws or bolts. It is intended that all of the foregoing features are made or mounted, onto one or both of the mounting plates in any variety of positions and juxtpositions being limited by the dimensions of the mounting plates and the particular devices being molded or mounted thereon.

The following is a continued description of how to use and make the invention.

1. assuming a side by side refrigerator door configuration one of the mounting plates is adhered to one of the refrigerator doors, near the door's opening edge, above the reach of children.

2. The other mounting plate is mounted on the adjacent door at a distance close enough to the edge of the door to allow the spring hook on the end of the shock cord sometimes herein referred to as lanyard to reach the other mounting plate loop with minimal or no tension apparent on the lanyard.

3. The lanyard end with spring clasp is hooked onto the loop and thus the refrigerator door can now be only slightly opened before the resistance in the lanyard increases to a degree that the door is kept from opening further and if the door is released the tension in the lanyard will shut the door as the lanyard returns to its relaxed state. This enabled configuration is as shown in FIGS. 2 and 5.

4. The added amenities when calling for battery operation are made so as to be able to replace batteries without having to remove the mounting pad from the place it is mounted to.

5. The surface of the mounting pad which is to operate as a writing surface is a non-porous smooth surface which will allow easy erasure of marks made by delible or erasable ink markers, pens or pencils.

6. The spring clamp for holding note paper is located so that the paper hanging from the clamp will not be interfered with by the body of the spring clasp or lanyard loop.

7. The lanyard is generally made of shock cord having a limited stretch capability of from about thirty percent of diameter to about 250 percent of diameter, however string or rope or ball chains or decorative chains or lanyards or elastic cloth or rubberbands, or combination of these items may be used in its place, and is generally from two to thirty inches in overall length, once the loops have been formed thereon.

8. As shown in FIG. 1, the lanyard may be comprised of a length of shock cord being manufactured to have two loops, one at each end, for connecting the shock cord to either Spring clasp or mounting plate loop are held looped by tying the looped over end of the shock cord down onto itself with wire or thread or string or by metal staples or clasps or clamps 5*a* as shown in FIG. 1.

9. The mounting plates range in size from one square inch to two hundred fifty square inches. The loops comprise rings mounted or molded onto the mounting plates. The mounting plates are made of metal or plastic or wood or glass or a combination thereof. The rings have an inner diameter 3*k* as shown in FIG. 9, of from about one half inch to about two inches and may be oval in shape having the aforementioned diameters in respective minor and major diameters and they may also be approximately square instead of circular or oval with the same range of dimensions as described above. The cross section of a ring segment would range in size from one sixteenth inch square to three eighths inch square.

What is claimed is:

1. A device for making a refrigerator door or other closure child resistant, comprising:

first and second mounting plates each having front and back sides and each being from about 1 square inch to 250 square inches in area and from about one sixteenth inch to one half inch thick and each having lanyard attaching means comprising a flat loop mounted to its front side in a perpendicular plane relative to the plane of the mounting plate and being tangent along a segment of said loop with said mounting plate and an adhesive surface on said back side of each mounting plate, wherein further said loop has an inner diameter of from about one half inch to about two inches and is oval or approximately square; wherein said first and second mounting plates are made from any one or two or any combination of the following materials: wood, plastic, steel, brass, bronze, copper, stainless steel, fiberglass, aluminum, magnesium, zinc coated iron, corrosion resistant metal alloys, non photo degradable plastic;

a length of shock cord from two to thirty inches long, sometimes hereafter referred to as, lanyard, said lanyard having a limited stretch capability of from about thirty percent of diameter to about 250 percent of diameter and having first and second ends with said lanyard first end mounted to said loop on said second mounting plate;

a releasable spring clasp having a clasp end and a plain or swivel eyelet butt end mounted by said butt end to said lanyard second end for attaching said lanyard second end to said first mounting plate via the spring clasp when said first mounting plate is adhered via its adhesive backing to one part of a two part closure of the refrigerator door and said second mounting plate is mounted to the other part of said closure so that the lanyard is fully extended to slightly stretched when so connected but having enough stretching capability remaining to allow an adult to easily remove said spring clasp attached to said lanyard from said first mounting plate.

2. The device of claim 1, wherein the lanyard has first and second ends and wherein the ends of the shock cord are formed into loops which has an inner loop diameter of from one eighth inch to two inches and wherein further the loops are fixed in place by metal crimp clamps or by tying with wire or thread or string said loop formed on and of itself on at least one end by means of clamping down an end of said lanyard that has been folded over onto itself forming a closed loop at the end of said lanyard;

wherein said loop of the first and/or second mounting plate is comprised of an open loop having a mouth and a cupping segment, said open loop comprising from about one half circle to about fifteen sixteenths circle of said loop having a segment removed adjacent to a tangent part of said loop which is tangent to said mounting plate resulting in the said mouth of said open loop so that the lanyard loop may just barely enter the mouth of the resulting open loop;

and wherein said lanyard comprises from two to thirty inches of shock cord, said open loop having the capacity to hold a shock cord pulling load against said cupping segment in the direction away from the mouth of said open loop within forty-five degrees, of a line generally parallel and in line with the plane of said open loop, of at least five pounds.

3. The device of claim 1, wherein the second mounting plate comprises a utility plate having a face side and an adhesive backing wherein further there is incorporated anywhere onto the face of said utility plate a battery operated cooking alarm with a battery access service door approachable from the face and said utility plate face side further comprises either a plastic, paper or metal writing surface.

4. The device of claim 3, wherein one or both of the mounting plates comprises a writing pad having a battery operated night light positioned in an area on the surface of the writing pad above a central portion area of the writing pad.

5. The device of claim 1, wherein the second mounting plate comprises a utility plate and wherein said utility plate further comprises any one or more of the following additional features in any combination or relative position on its face side; a writing pad, a paper clamp, a pen/pencil pocket or cup, a pen/pencil tether, a battery operated night light, a battery or mechanically operated clock, at least one utility hook capable of holding a minimal load of car and house keys or pot holders which weigh at least two ounces, a battery or mechanical cooking timer; two spring clasps, one attached to each end of said lanyard, and wherein the batteries, if any, may be serviced or replaced while the utility plate is mounted to a solid surface, by approaching the front side of said utility plate and the mechanical cooking timer or mechanical clock may be wound or reset in situ when the mounting plate is mounted to a surface.

6. The device of claim 1, wherein both the first and the second end of said lanyard are each attached to one of two said spring clasps' plain or swivel eyelet butt end.

7. The device of claim 6 wherein said spring clasp comprises hooking means and said first and second ends for mounting said spring clasp butt end or said swivel eyelet butt end to said shock cord or lanyard comprises means for connecting a hook or spring clasp to a shock cord end.

8. The device of claim 1 wherein one or both of said mounting plates further comprise a clip board and a pencil tether.

9. The device of claim 1 wherein the shock cords is form 3 inches to 10 inches long and form one eighth inch to 13/16 inch in diameter and the spring clasp is made of plastic.

10. The device of claim 1 wherein the loop of the first mounting plate is comprised of an open loop.

11. The device of claim 1 wherein one or both of the mounting plates further comprise a writing surface, each having a paper clamp mounted thereon and pencil mounting means.

12. The device of claim 1 wherein one or both of the mounting plates further comprise a writing tablet, having a paper clamp mounted thereon and pencil mounting means.

13. The device of claim 1 wherein the lanyard is made of any one of the following: wire cable or rubber bands.

14. The device of claim 1, wherein one or both of said first and second mounting plates comprise a writing pad having a central portion area for writing on and which further comprises either a battery operated night light or a cooking timer positioned in an area on the surface of the writing pad above a central portion area of the writing pad.

15. The device of claim 14 wherein the mounting plates have a face dimension of from 6 to twelve inches wide and/by from 6 to 14 inches high and further have a bottom edge being from ¼ inch to 1½ inches in height and along the entire width of the mounting plate and having from one to ten utility hooks mounted along the said bottom edge of the mounting plate in random or unform spacing between said utility hooks.

16. The device of claim 1 wherein said spring clasp comprises hooking means and said first and second ends for mounting said spring clasp butt end to said shock cord or lanyard comprises means for connecting a hook or spring clasp to a shock cord end.

17. A kit for making a latch on a closure and/or a refrigerator door child resistant comprising; first and second mounting plates each having front and back sides and each having a loop mounted to its front side and each having an adhesive backing and/or being pre-drilled for mounting with screws, rivets or bolts;

a shock cord from two to thirty inches long, sometimes hereafter referred to as, lanyard, said lanyard having a limited stretch capability of from about thirty percent of diameter to about 250 percent of diameter and having first and second ends with said shock cord first end mounted to said loop on said second mounting plate and a spring clasp mounted to said shock cord second end which can be used to hook onto the loop of said first mounting plate and thereby engage the mounting plates to each other via the spring clasp and shock cord.

18. A kit for making a refrigerator door or other closure child resistant, comprising:

first and second mounting plates each having front and back sides and each being from about 1 square inch to 250 square inches in area and from about one sixteenth inch to one half inch thick and each having lanyard attaching means comprising a flat loop mounted to its front side in a perpendicular plane relative to the plane of the mounting plate and being tangent along a segment of said loop with said mounting plate and an adhesive surface on said back side of each mounting plate, wherein further said loop has an inner diameter of from about one half inch to about two inches; wherein said first and second mounting plates are made from any one or two or any combination of the following materials: wood, plastic, steel, brass, bronze, copper, stainless steel, fiberglass, aluminum, magnesium, zinc coated iron, corrosion resistant metal alloys, non photo degradable plastic;

a length of shock Cord from two to thirty inches long, sometimes hereafter referred to as, lanyard, said lanyard having a limited stretch capability of from about thirty percent of diameter to about 250 percent of diameter and having first and second ends with said lanyard first end mounted to said loop on said second mounting plate;

a releasable spring clasp having a clasp end and a plain or swivel eyelet butt end mounted by said butt end to said lanyard second end for attaching said lanyard second end to said first mounting plate via the spring clasp when said first mounting plate is adhered via its adhesive backing to one part of a two part closure and said second mounting plate is mounted to the other part of said closure so that the lanyard is fully extended to slightly stretched when so connected but having enough stretching capability remaining to allow an adult to easily remove said spring clasp attached to said lanyard from said first mounting plate.

19. The kit of claim 18, wherein said second mounting plate and/or said first mounting plate comprise any one or more of the following additional features in any combination or relative position on the mounting plate's face side; a writing pad, a paper clamp, a pen/pencil pocket, a pen/pencil tether, a battery operated night light, a battery or mechanically operated clock; at least one utility hook capable of holding a minimal load of car and house keys or pot holders which weigh at least two ounces, a battery or mechanical cooking timer; two spring clasps, one attached to each end of said lanyard, and wherein the batteries, if any, may be serviced or replaced while the utility plate is mounted to a solid surface, by approaching the front side of said utility plate and the mechanical cooking timer or mechanical clock may be wound or reset in situ when the mounting plate is mounted to a surface; wherein further said first and second mounting plates are pre-drilled for mounting said mounting plates to a surface with screw, rivet or bolt means.

* * * * *